US006832526B2

(12) United States Patent
Koyama et al.

(10) Patent No.: US 6,832,526 B2
(45) Date of Patent: Dec. 21, 2004

(54) BENDING METHOD AND SINGLE ELONGATION VALUE SPECIFYING DEVICE OF BENDING APPARATUS

(75) Inventors: Junichi Koyama, Kanagawa (JP); Kazunari Imai, Kanagawa (JP); Osamu Hayama, Kanagawa (JP); Hitoshi Omata, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 10 days.

(21) Appl. No.: 10/311,325

(22) PCT Filed: Jul. 4, 2001

(86) PCT No.: PCT/JP01/05801

§ 371 (c)(1),
(2), (4) Date: Dec. 30, 2002

(87) PCT Pub. No.: WO02/02256

PCT Pub. Date: Jan. 10, 2002

(65) Prior Publication Data

US 2003/0105548 A1 Jun. 5, 2003

(30) Foreign Application Priority Data

Jul. 5, 2000 (JP) ..... P2000-203794

(51) Int. Cl.[7] ..... G01N 3/20
(52) U.S. Cl. ..... 73/849
(58) Field of Search ..... 73/849; 72/31.1; 700/97

(56) References Cited

U.S. PATENT DOCUMENTS 5,857,366 A 1/1999 Koyama
5,969,373 A 10/1999 Harris
5,980,085 A * 11/1999 Uemura et al. ..... 700/97
6,035,242 A * 3/2000 Uemura et al. ..... 700/97
6,298,700 B2 10/2001 Nagasawa
6,662,610 B1 * 12/2003 Sekita et al. ..... 72/31.1
2003/0010078 A1 * 1/2003 Koyama et al. ..... 72/31.1
2003/0084702 A1 * 5/2003 Sekita et al. ..... 72/461

FOREIGN PATENT DOCUMENTS

JP 3-114614 5/1991
JP 4-279219 10/1992
JP 10-58044 3/1998

OTHER PUBLICATIONS

English Language Abstract of JP 10–58044.
English Language Abstract of JP 3–114614.
English Language Abstract of JP 4–279219.

* cited by examiner

*Primary Examiner*—Edward Lefkowitz
*Assistant Examiner*—T Miller
(74) *Attorney, Agent, or Firm*—Greenblum & Bernstein, P.L.C.

(57) ABSTRACT

A bending apparatus for bending a workpiece W according to cooperation of a punch P and a die D previously carries out various step bending or makes simulation of step bending, and calculates an approximation formula based on a correlation between a ratio % of a one-sided elongation value α to a plate thickness t and a step bending angle θ based on a relationship among the plate thickness t, the step bending angle θ and the one-sided elongation value α of the workpiece W so as to store the formula as a database. The more accurate one-sided elongation value α of the step bending is calculated by small parameters including only two data including the plate thickness t and the step bending angle θ previously input at the time of actual bending based on the approximation formula in the data base so that the bending is carried out easily.

6 Claims, 9 Drawing Sheets

RELATIONSHIP BETWEEN PLATE THICKNESS AND ONE-SIDED ELONGATION (90°)

RELATIONSHIP BETWEEN PLATE THICKNESS AND ONE-SIDED ELONGATION (45°)

BENDING METHOD AND SINGLE ELONGATION VALUE SPECIFYING DEVICE OF BENDING APPARATUS

TECHNICAL FIELD

The present invention relates to a bending method of accurately detecting an elongation value of particularly step bending when a plate-shaped workpiece is bent and a apparatus for specifying one-sided elongation value in a bending apparatus.

BACKGROUND ART

Conventionally, in a bending apparatus such as a press brake, when a plate-shaped workpiece is bent by cooperation of a punch and a die, an elongation value of step bending is calculated based on many pieces of information including mold data such as a die V width V, a die shoulder are DR, a die groove angle DA, a punch end are PR and a punch angle PA, workpiece data such as bending conditions such as a plate thickness t and a friction coefficient $\mu$, material constants such as a Young's modulus E, a Poisson's ratio, an F value and an n value of a workpiece, and mechanical data such as a stroke of a ram.

A workpiece is developed, blanked and bent based on the calculated elongation value.

Incidentally, in the conventional bending method and its apparatus, since an elongation value of V bending is calculated by the above elongation value calculating method, there arises a problem that this value does not coincide with an actual elongation value of step bending.

Namely, the most V bending is working for bending totally three points: one point of a punch and two points of a die, but the step bending is working which is not normal V bending and in which V (a width of a V groove of a V-shaped mold)/T (plate thickness) is small and also bending is carried out in a state close to coining. For this reason, the elongation values of the V bending and the step bending are inevitably different from each other even if their other bending conditions (plate thickness, bending angle and the like) have the same values. Therefore, since conventionally the elongation value obtained by the V bending is sued so that the step bending is carried out, an error occurs.

In addition, in order to calculate an elongation value, there arises a problem that many pieces of information such as mold data, workpiece data and mechanical information are necessary.

Therefore, since the calculated elongation value does not coincide with an actual working state as mentioned above, trial bending is carried out in the bending and a finished dimension is actually measured so that an elongation value of the bending is obtained. Therefore, there arises a problem that the step bending requires more time for setup of the bending than the normal V bending.

The present invention is devised in order to solve the above problems, and its object is to provide a bending method of being capable of operating an elongation value of step bending accurately from only two pieces of information including a plate thickness and a bending angle and of carrying out bending, and an apparatus for specifying a one-sided elongation value in the bending apparatus.

DISCLOSURE OF THE INVENTION

In order to achieve the above object, a bending method of the present invention based on a first aspect includes the steps of: before step-bending a workpiece by means of cooperation of a punch and a die, previously carrying out various step bending and making simulation of step bending and calculating an approximation formula based on a correlation between a ratio of a one-sided elongation value to a plate thickens and a step bending angle based on a relationship among the plate thickness, the bending angle and the one-sided elongation value of a workpiece so as to store the approximation formula as a database; at the time of actual bending, capturing two data including a specified plate thickness and a step bending angle into the database so as to calculate a one-sided elongation value based on the approximation formula in the database; and carrying out bending based on the one-sided elongation value.

In the bending method based on the first aspect, the various step bending to be carried out previously is carried out by using a step bending mold to be used at the time of actual bending, carried out later.

In addition, the various step bending to be carried out previously may be carried out by simulation using a step bending mold to be used at the time of actual bending, carried out later.

Therefore, the approximation formula of the correlation between the ratio of the one-sided elongation value to the plate thickness and the step bending angle is previously calculated so as to be stored as a database, and the more accurate one-sided elongation value is obtained easily by less parameters including only two data including the plate thickness and the step bending angle based on the approximation formula. The bending is carried out efficiently and accurately based on the one-sided elongation value without previously carrying out trial step bending.

An apparatus for specifying a one-sided elongation value in a bending apparatus of the present invention based on a second aspect includes: a computing unit for previously carrying out various step bending or making simulation of step bending so as to calculate an approximation formula based on a correlation between a ratio of a one-sided elongation value to a plate thickness and a step bending angle based on a relationship among the plate thickness, the bending angle and the one-sided elongation value of a workpiece; a database file for storing the approximation formula calculated by the computing unit as a database; and a one-sided elongation value computing unit for specifying and capturing a plate thickness and a step bending angle at the time of actual bending into the approximation formula in the database file so as to calculate a one-sided elongation value.

In the apparatus for specifying a one-sided elongation value in a bending apparatus based on the second aspect, the various step bending previously carried out is carried out by using a step bending mold to be used at the time of actual bending, carried out later.

In addition, the various step bending previously carried out may be carried out by simulation using a step bending mold to be used at the time of actual bending, carried out later.

Therefore, the function of the second aspect is similar to the function of the first aspect. The approximation formula of the correlation between the ratio of the one-sided elongation value to the plate thickness and the step bending angle is calculated so as to be stored as a database, and the more accurate one-sided elongation value of the step bending is obtained easily by less parameters including only two data including the plate thickness and the step bending angle based on the approximation formula. The bending is carried out efficiently and accurately based on the one-sided elongation value without previously carrying out trial step bending.

THE BEST MODE FOR CARRYING OUT THE INVENTION

There will be explained below a bending method and an apparatus for specifying a one-sided elongation value in the bending apparatus according to an embodiment of the present invention with reference to the drawings.

Here the one-sided elongation value is an apparent elongation amount on one side of a plate-shaped workpiece to be bent when apparent elongation is generated by a bent surface (R or bent R) of the workpiece by a vicinity of the peak of both side tilt surfaces of a punch in the case where bending is carried out by a peak of the punch and a groove of a die.

Figure 3:
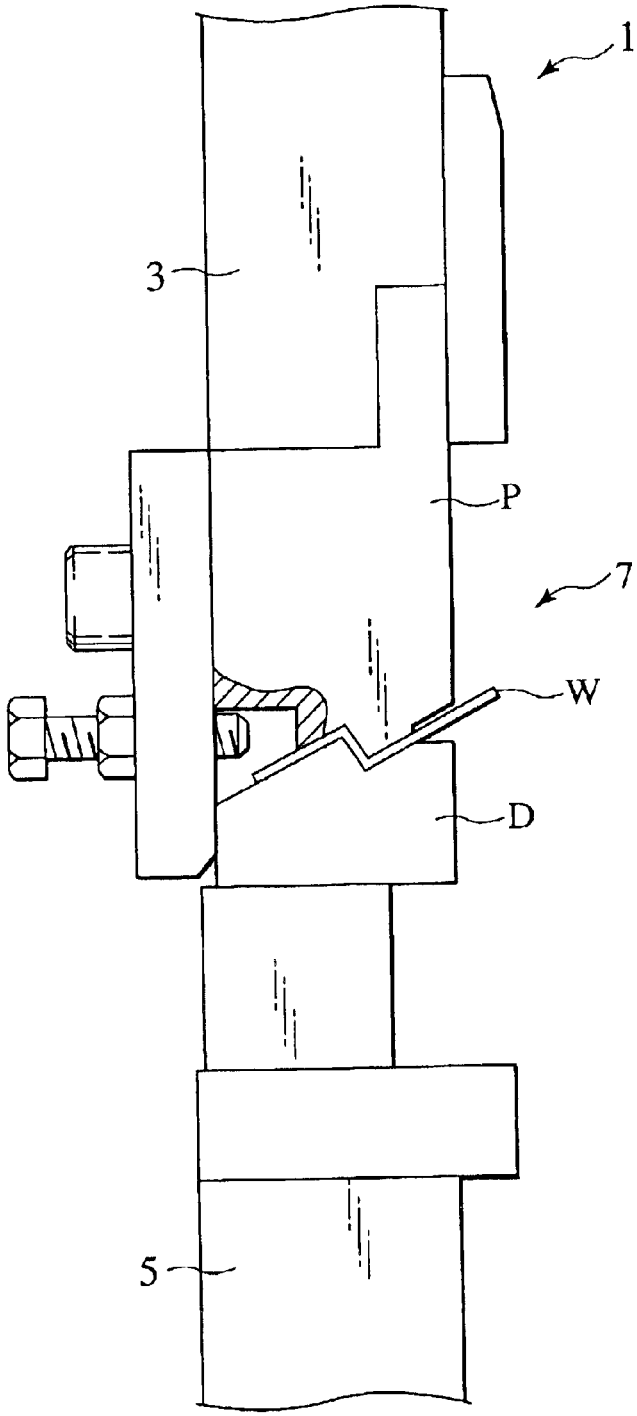
FIG. 3 is a state explanatory diagram that the step bending is carried out by a flap-type mold of a press brake to be used in the embodiment of the present invention.

FIG. 3 shows a state that a plate-shaped workpiece W is step-bent by a mold composed of a punch P, for example, as a movable mold of a bending apparatus according to the present embodiment such as a press brake 1 and a die D, for example, as a fixed mold.

Since the press brake 1 is well known, the detailed explanation thereof is omitted and only its outline will be explained. The press brake 1 is provided a ram 3, which is capable of moving up and down by up-down driving means such as a hydraulic cylinder, on an upper front surface of a side frame, not shown, in a standing position, and a punch P is detachably mounted to a lower part of the ram 3 via a punch mounting section. Meanwhile, a lower table 5 is fixed to be provided on a lower front surface of the side frame, and a die D is detachably mounted to an upper surface of the lower table 5.

Figure 4:
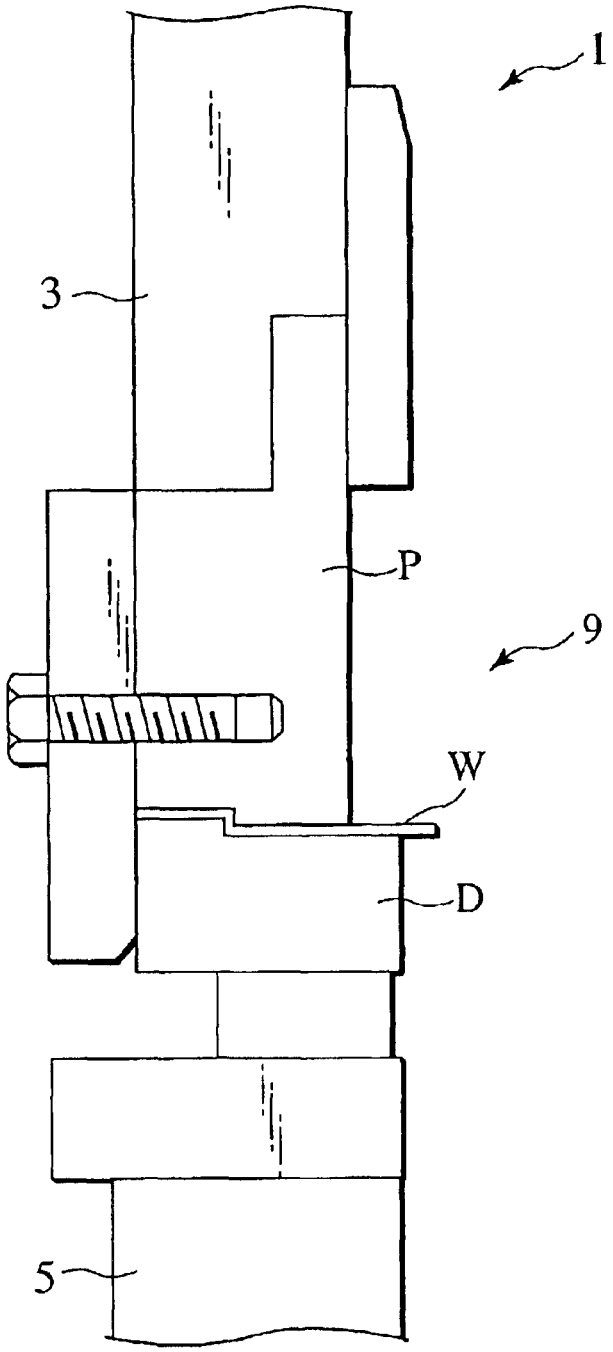
FIG. 4 is a state explanatory diagram that the step bending is carried out by a horizontal mold of the press brake to be used in the embodiment of the present invention.

The punch P and the die D shown in FIG. 3 is a flap-type step bending mold 7, and the punch P and the die D shown in FIG. 4 is a horizontal step bending mold 9.

In addition, the press brake 1 is provided with a control device 11 for automatically controlling a stroke of the up-down movement of the ram 3 and calculating a one-sided elongation value of step bending.

Figure 1:
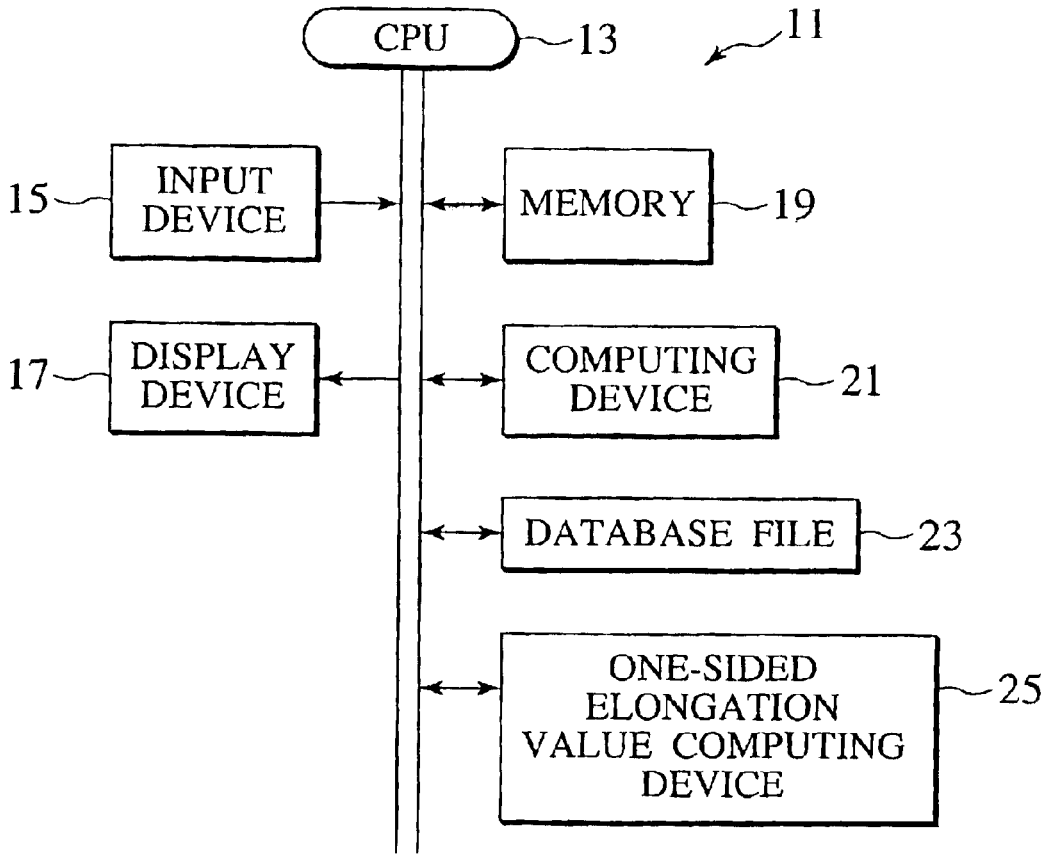
FIG. 1 is a structural block diagram of a control device.

As shown in FIG. 1, in the control device 11, a CPU 13 as a central processing unit is connected with an input device 15 such as a keyboard for inputting various data and a display device 17 such as a CRT for displaying various data.

In addition, the CPU 13 is connected with a memory 19 for storing bending conditions such as mold data input by the input device 15 including a die DV width V, a die D shoulder are DR, a die D groove angle DA, a punch P end are PR, a punch P angle PA and a punch P tilt length PL, workpiece W data including a plate thickness t, a friction coefficient $\mu$, a workpiece W flange length L and a bending angle θ.

Further, the CPU 13 is connected with a computing unit 21 for previously carrying out various step bending or making simulation using a step bending mold so as to calculate an approximation formula established by correlation between a ratio of a one-sided elongation value to a plate thickness and a step bending angle based on a relationship among the plate thickness, the step bending angle and the one-sided elongation value of the workpiece W, and a database file 23 for storing the approximation formula calculated by the computing unit 21 as a database, and a one-sided elongation value computing unit 25 for specifying and capturing a plate thickness and a step bending angle at the time of actual bending based on the approximation formula of the data base file 23 so as to calculate a one-sided elongation value.

Here, in the above control unit 11, for example, a numerical value control device, such as an automatic programming unit having the computing device 21 for calculating a one-sided elongation value, the data base file 23 and the one-sided elongation value computing unit 25, may be provided separately from the control unit 11 for the press brake.

With the above structure, there will be explained below a process for calculating the approximation formula using the computing unit 21.

The press brake 1 to which step bending molds have been mounted for the workpieces W with various plate thickness made of different materials is used, so as to actually carry out step bending and obtain one-sided elongation values. A relationship among the material, the plate thickness and the one-sided elongation value is sorted out for each step bending angle θ so as to be shown in the graph.

Namely, the data in FIGS. 7 through 13 are experimental data which are obtained by actually step-bending the individual workpieces W with different plate thicknesses in the respective step bending molds with different angles.

Figure 5:
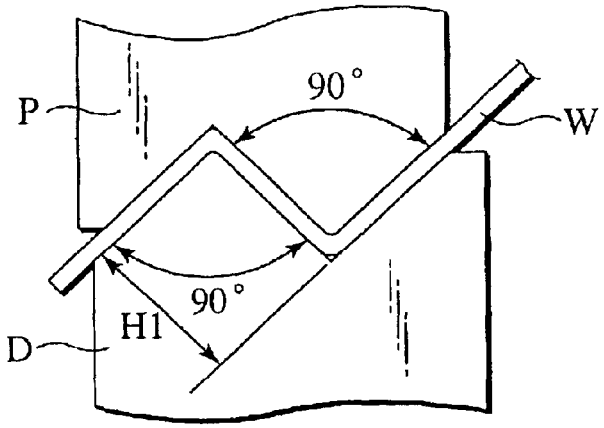
FIG. 5 is a state explanatory diagram that the step bending is carried out by a mold with a step bending angle of 90°.
Figure 7:
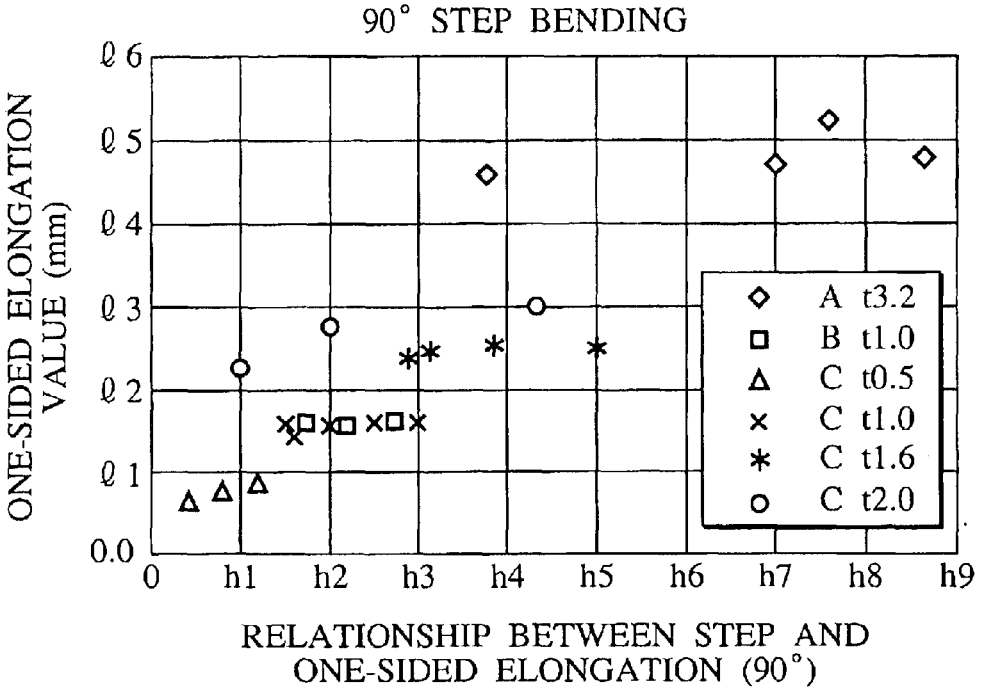
FIG. 7 is a graph showing a relationship between a step and a one-sided elongation value at the step bending angle of 90°.

For example, in the case where the step bending angle θ is 90° as shown in FIG. 5, in the relationship graph between a one-sided elongation value $\alpha$ and a step H1 obtained in the above manner, the one-sided elongation value $\alpha$ is different according to the plate thickness t as shown in FIG. 7, but even if the step amount H1 and the material are different, the one-sided elongation value $\alpha$ is constant at the same plate thickness t. Namely, it is found that the step bending one-sided elongation value $\alpha$ is not very influenced by the step amount H1 and the material.

Here, in FIG. 7, in the workpiece W, the plate thickness t of a material A is 3.2 mm, the plate thickness t of a material B is 1.2 mm, the plate thickness t of a material C is 1.0 mm, 1.6 mm and 2.0 mm.

Figure 9:
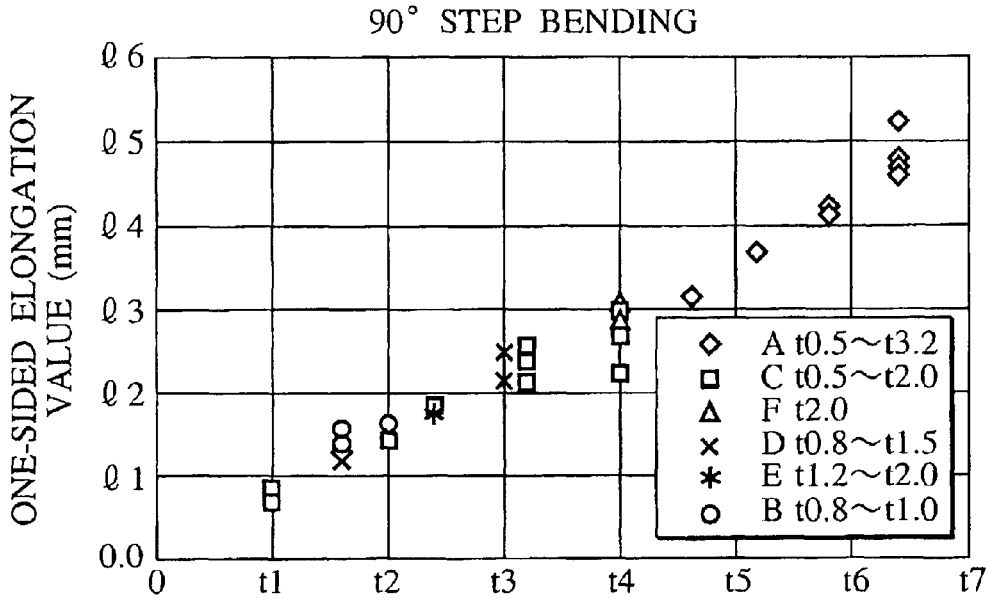
FIG. 9 is a graph showing a relationship between a plate thickness and one-sided elongation value at the step bending angle of 90°.

In addition, in the relationship graph between the one-sided elongation value $\alpha$ and the plate thickness t in the case where the step bending angle $\theta$ is 90°, it is found that the one-sided elongation value $\alpha$ is approximately directly proportional to the plate thickness t regardless of a difference in the material as shown in FIG. 9. Moreover, the one-sided elongation value $\alpha$ is not very influenced by the material. Here, in FIG. 9, in the workpieces W, the plate thickness t of a material A is 0.5 to 3.2 mm, the plate thickness t of a material B is 0.8 to 1.0 mm, the plate thickness t of a material C is 0.5 to 2.0 mm, the plate thickness t of a material D is 0.8 to 1.5 mm and the plate thickness t of a material E is 1.2 to 2.0 mm.

Figure 6:
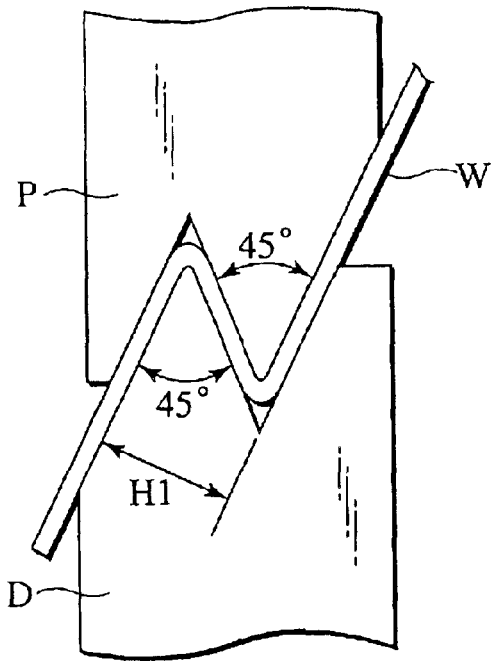
FIG. 6 is a state explanatory diagram that the step bending is carried out by a mold with a step bending angle of 45°.
Figure 8:
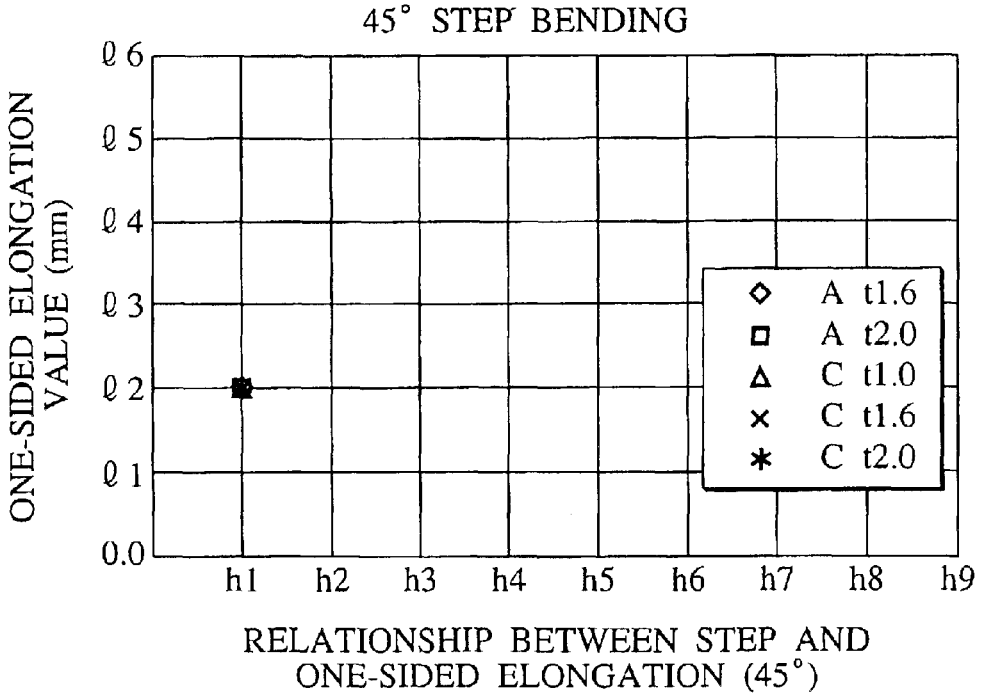
FIG. 8 is a graph showing a relationship between a step and a one-sided elongation value αt the step bending angle of 45°.
Figure 10:
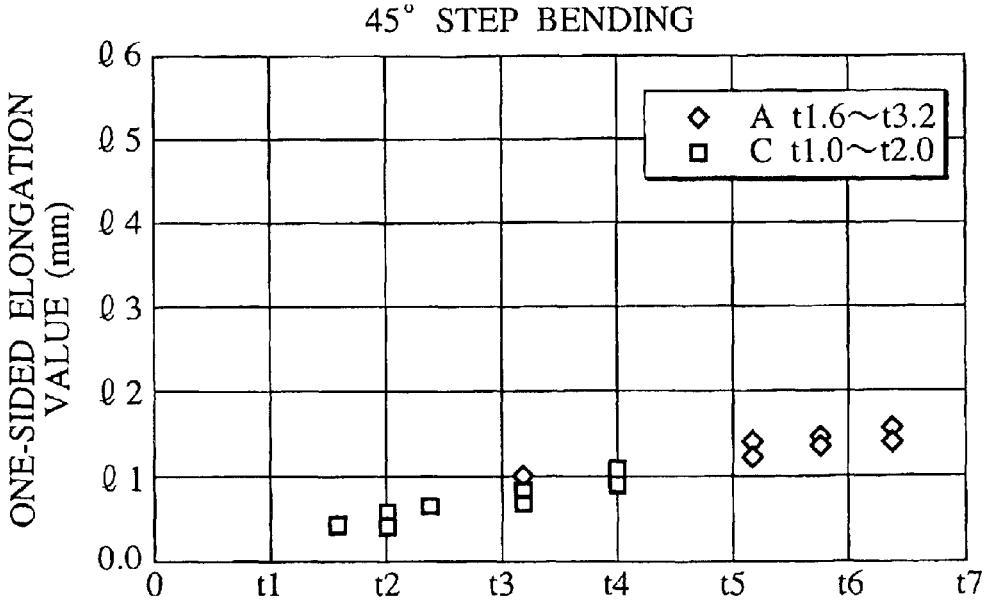
FIG. 10 is a graph showing a relationship between a plate thickness and one-sided elongation value at the step bending angle of 45°.

In addition, the case where the step bending angle $\theta$ is 45° as shown in FIG. 6 is similar to the case where the step bending angle $\theta$ is 90°. Namely, in the relationship graph between the one-sided elongation value $\alpha$ and the step H1, as shown in FIG. 8, the one-sided elongation value $\alpha$ of the step bending is not very influenced by the step amount and the material. Moreover, in the relationship graph between the one-sided elongation value $\alpha$ and the plate thickness t, as shown in FIG. 10, the one-sided elongation value $\alpha$ is approximately directly proportional to the plate thickness t regardless of a difference in the materials.

Accordingly, when the step bending is considered to be bending (the state close to coining) when V/t (V: width/plate thickness: t) of the normal V bending is extremely small, the influence of a material upon the one-sided elongation value $\alpha$ is small.

Figure 11:
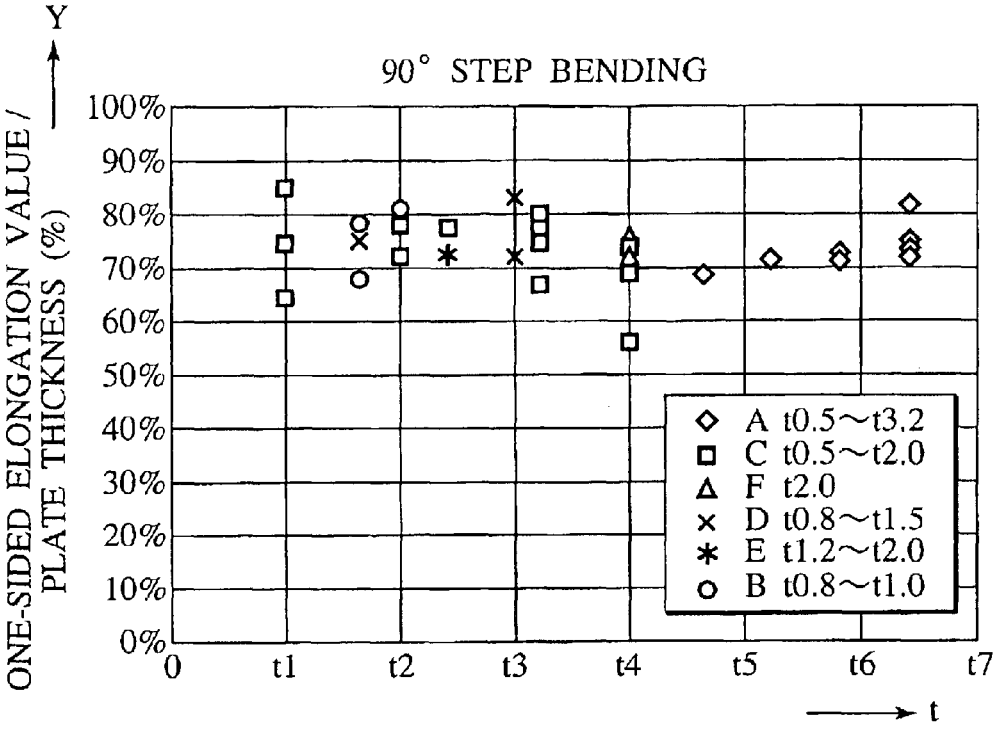
FIG. 11 is a graph showing a relationship between elongation value/plate thickness (one-sided elongation ratio Y) and a plate thickness at the step bending angle of 90°.
Figure 12:
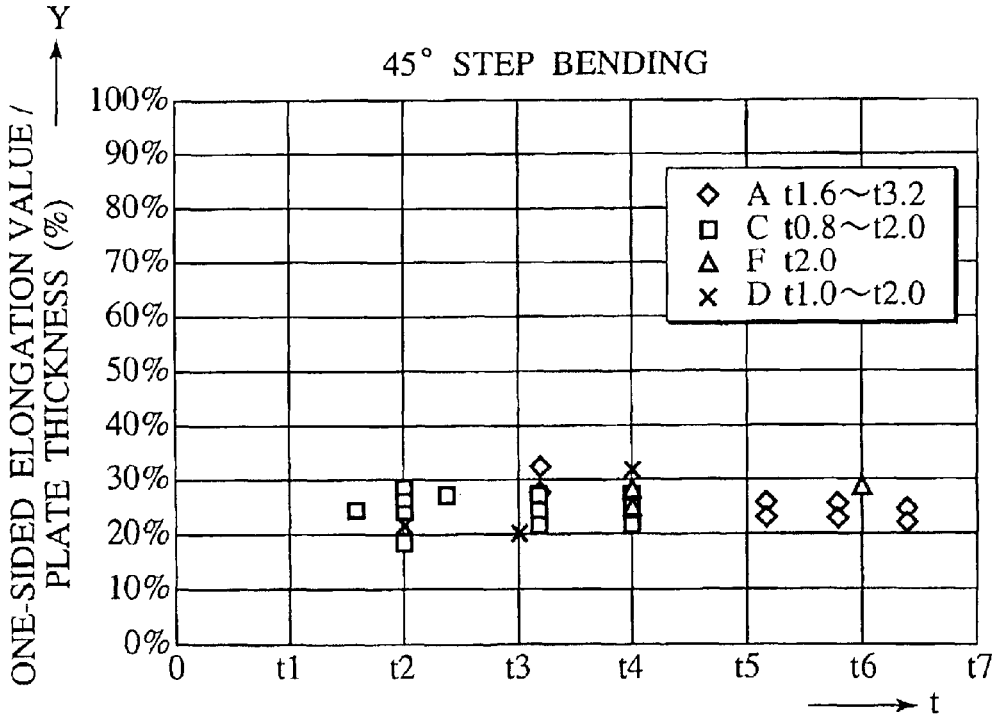
FIG. 12 is a graph showing a relationship between elongation value/plate thickness (one-sided elongation ratio Y) and a plate thickness at the step bending angle of 45°.

With reference to FIGS. 11 and 12, it is found that in the case where the relationship between the one-sided elongation value $\alpha$/plate thickness t (%) and the plate thickness t is represented in the graph for each step bending angle $\theta$, for example, when the step bending angle $\theta$ is 90°, the one-sided elongation value $\alpha$/plate thickness t (%) becomes constant, i.e., approximately 75% regardless of a difference in the plate thickness t, and when the step bending angle $\theta$ is 45°, the one-sided elongation value $\alpha$/plate thickness t (%) becomes constant, i.e. approximately 25% regardless of a difference in the plate thickness t.

Therefore, the one-sided elongation value $\alpha$ of the step bending is not influenced by a material but only by plate thickness t particularly, and when the step bending angle $\theta$ is constant, the one-sided elongation value $\alpha$/plate thickness t (%) also becomes constant. For this reason, the relationship between the step bending angle $\theta$ and the one-sided elongation value $\alpha$/plate thickness t (%) is represented by a graph shown in FIG. 13.

Figure 13:
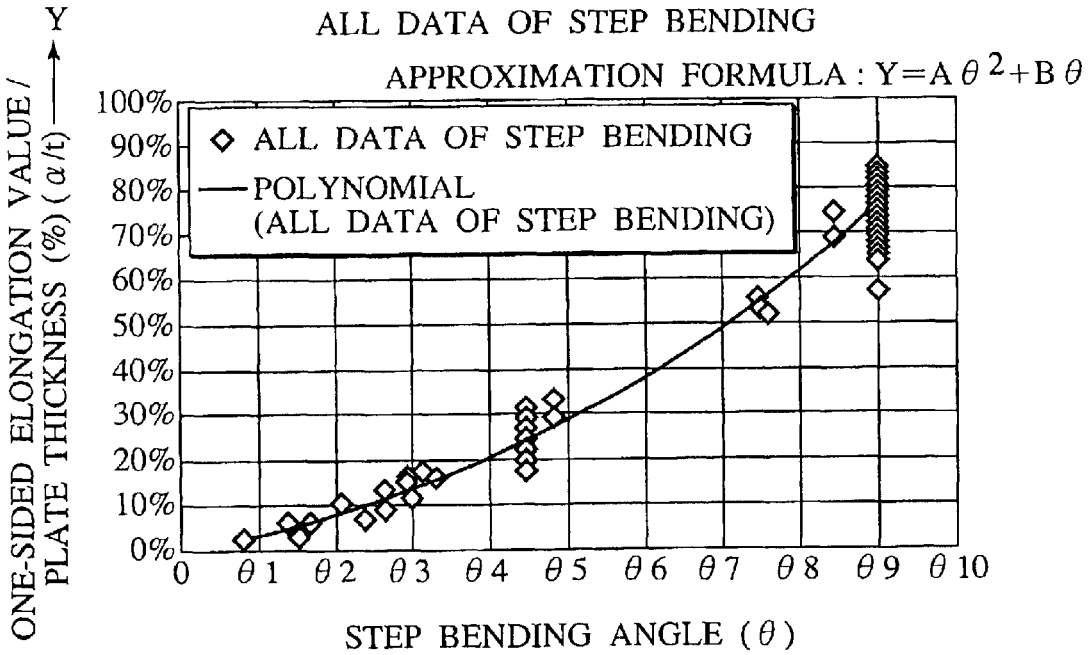
FIG. 13 shows the embodiment of the present invention and is a graph showing a relationship between the one-sided elongation ratio Y and the step bending angle in all the step bending data.

The graph shown in FIG. 13 is previously calculated by the computing unit 21 from data which are obtained by step-bending the workpieces W with various plate thickness made of different materials using the press brake 1. The approximation formula of a curved line in the graph of FIG. 13 is calculated by the computing unit 21 so as to be stored in the database file 23.

For example, when the one-sided elongation value $\alpha$/plate thickness t (%) is represented as a one-sided elongation ratio ($Y=\alpha/t$), it is calculated as $Y=A\theta 2+B\theta$ or $Y=C\theta+D$ in the approximation formula.

However, $\theta$=step bending angle, and A, B, C and D=approximation formula constants.

Therefore, the one-sided elongation value $\alpha$ is represented as follows:

$\alpha=t\cdot Y=t\cdot(A\theta 2+B\theta)$, or $\alpha=t\cdot(C\theta+D)$, and thus $\alpha=f(t, \theta)$.

As explained above, $\alpha=f(t, \theta)$ is calculated by the computing unit 21 so as to be previously stored in the database file 23.

Figure 2:
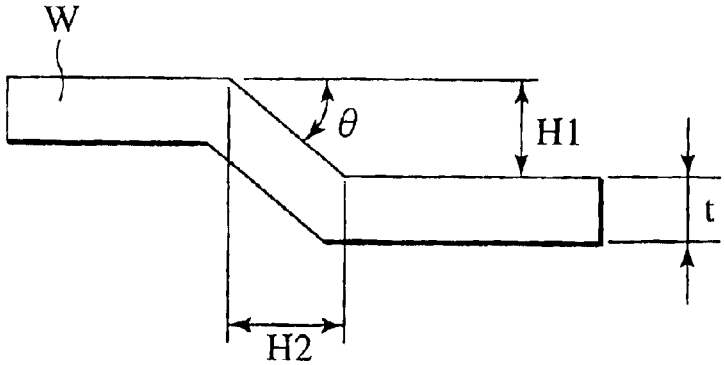
FIG. 2 is a state explanatory diagram of a workpiece subject to step working according to an embodiment of the present invention.

Therefore, at the time of actual step bending, when the input device 15 inputs the plate thickness t, the step amounts H1 and H2 or the bending angle $\theta$ as shown in FIG. 2 based on product drawing information or CAD data, the one-sided elongation value computing unit 25 easily calculates accurate one-sided elongation value $\alpha$ based on the approximation formula: $\alpha=f(t, \theta)$ in the database file 23. The calculated one-sided elongation value $\alpha$ is used so as to step-bending the workpieces W actually. Here, in the case where the step bending angle $\theta$ is not given but only the step amounts H1 and H2 are given as the input data, the one-sided elongation value $\alpha$ is obtained based on the step bending angle $\theta=\tan-1H1/H2$.

Figure 14:
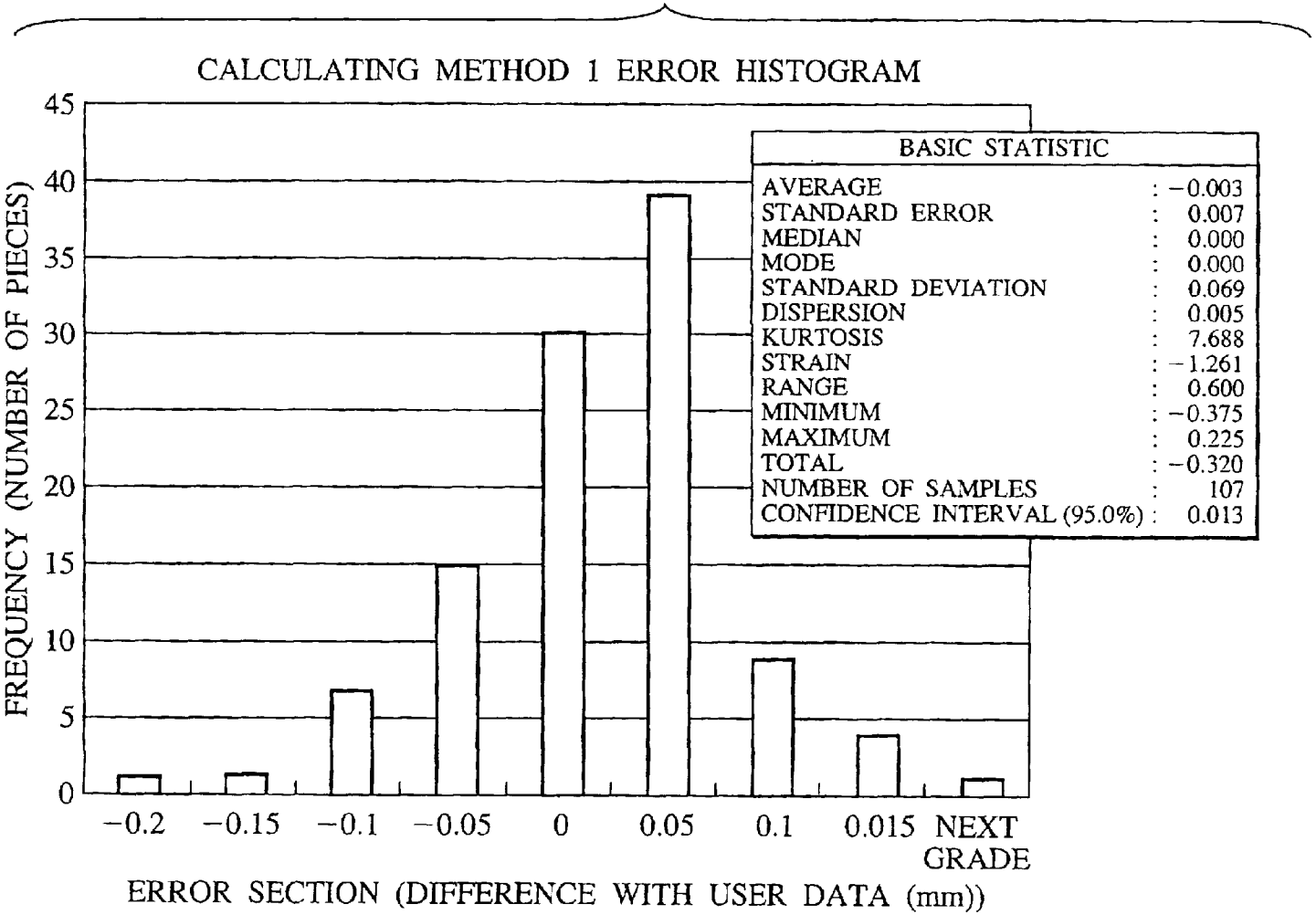
FIG. 14 is a histogram showing an error between the one-sided elongation value calculated in the embodiment of the present invention and an actual one-sided elongation value.

Incidentally, when a one-sided elongation value of actual experimental value is calculated for the workpieces W and a one-sided elongation value is calculated by the method of the present invention using the approximation formula and both the one-sided elongation values are compared with each other so that an error is calculated, an error range is shown by a histogram in which an average value of the error is −0.003 mm and a standard deviation is 0.069 as shown in FIG. 14.

Therefore, since the error range is too small to be almost ignored with respect to a general allowable error at the time of the actual step bending, the one-sided elongation value obtained by the method of the present invention represents the actual one-sided elongation value accurately.

As mentioned above, since there is a correlation between the ratio of the one-sided elongation value $\alpha$ to the plate thickness t (one-sided elongation ratio Y %) and the step bending angle $\theta$, the approximation formula $Y=f(\theta)$ of the correlation is previously calculated so that the approximation formula: $\alpha=f(t, \theta)$ is a database, so that the more accurate one-sided elongation value of the step bending can be obtained easily by less parameters including only two data such as the plate thickness t and the step bending angle $\theta$, and the bending can be carried out efficiently and accurately based on the one-sided elongation value without trial bending.

Particularly differently from the step bending based on one-sided elongation value due to the conventional V bending, since the one-sided elongation value based on the data obtained by actual step bending using a step bending mold is adopted, the step bending is carried out more accurately.

Here, the present invention is not limited by the above-mentioned embodiment and can be carried out in another form by slidable modification.

For example, simulation which is similar to the actual working is made by the step bending mold to be used for the actual step bending so that the relationships shown in FIGS. 9 to 13 can be shown on the graph.

In addition, the step bending mold at the time of collecting data to be captured into the database and the step bending mold used at the time of the actual bending, carried out later, may have the same shape, material and dimension, or different shapes, materials and dimensions. Namely, both the working mold at the time of collecting data to be captured into the database and the working mold to be used for the actual bending, carried out later, may be step bending molds.

What is claimed is:

1. A bending method, comprising:

determining, from at least one of simulated step bending and test step bending of a workpiece, a correlation between a one-sided elongation value, a plate thickness and a step bending angle;

calculating an approximation formula based on the correlation between a ratio of the one-sided elongation value to the plate thickness and the step bending angle;

storing the approximation formula;

obtaining, for actual bending of a workpiece, a specified plate thickness and a step bending angle, so as to calculate a one-sided elongation value for the actual bending based on the approximation formula; and bending the workpiece based on the one-sided elongation value.

2. The bending method according to claim 1, wherein the simulated step bending of a workpiece is performed using a step bending mold to be used for the actual bending.

3. The bending method according to claim 1, wherein the test step bending of a workpiece is performed using a step bending mold to be used for the actual bending.

4. An apparatus for specifying a one-sided elongation value in a bending apparatus, comprising:

a computing unit that determines, from at least one of simulated step bending and test step bending of a workpiece, a correlation between a one-sided elongation value, a plate thickness and a step bending angle, the computing unit calculating an approximation formula based on the correlation between a ratio of the one-sided elongation value to the plate thickness and the step bending angle;

a database that stores the approximation formula calculated by the computing unit;

a processing unit that determines, for actual bending of a workpiece, a specified plate thickness and a step bending angle, so as to calculate a one-sided elongation value for the actual bending based on the approximation formula.

5. The apparatus for specifying a one-sided elongation value in a bending apparatus according to claim 4, further comprising a step bending mold to be used for the actual bending when the simulated step bending of a workpiece is performed.

6. The apparatus for specifying a one-sided elongation value in a bending apparatus according to claim 4, further comprising a step bending mold to be used for the actual bending when the test step bending of a workpiece is performed.

* * * * *